US009979143B2

(12) United States Patent
Renggli et al.

(10) Patent No.: US 9,979,143 B2
(45) Date of Patent: May 22, 2018

(54) ARRANGEMENT AND METHOD FOR EQUIPPING PLUG HOUSINGS

(71) Applicant: Komax Holding AG, Dierikon (CH)

(72) Inventors: Urs Renggli, Hergiswil (CH); Beat Estermann, Dierikon (CH); Roland Liem, Stans (CH)

(73) Assignee: KOMAX HOLDING AG, Dierikon (CH)

( * ) Notice: Subject to any disclaimer, the term of this patent is extended or adjusted under 35 U.S.C. 154(b) by 158 days.

(21) Appl. No.: 14/970,729

(22) Filed: Dec. 16, 2015

(65) Prior Publication Data

US 2016/0181740 A1 Jun. 23, 2016

(30) Foreign Application Priority Data

Dec. 17, 2014 (EP) ..... 14198600

(51) Int. Cl.

| | |
|---|---|
| ***H01R 13/73*** | (2006.01) |
| ***H01R 43/20*** | (2006.01) |
| ***H01R 43/16*** | (2006.01) |
| *H01R 43/28* | (2006.01) |

(52) U.S. Cl.

CPC ..... *H01R 13/73* (2013.01); *H01R 43/16* (2013.01); *H01R 43/20* (2013.01); *H01R 43/28* (2013.01)

(58) Field of Classification Search

CPC ..... H01R 13/73; H01R 43/16; H01R 43/20; H01R 43/28

USPC ..... 439/529, 501

See application file for complete search history.

(56) References Cited

U.S. PATENT DOCUMENTS

| | | | | |
|---|---|---|---|---|
| 4,247,980 A | | 2/1981 | Tominoi | |
| 4,976,294 A | * | 12/1990 | Kudo | H01R 43/28 140/102 |
| 5,127,159 A | | 7/1992 | Kudo et al. | |
| 6,038,763 A | * | 3/2000 | Kodera | H01R 43/052 29/743 |
| 8,668,504 B2 | * | 3/2014 | Cofini | H01R 33/22 439/101 |
| 8,853,541 B2 | * | 10/2014 | Ingram, Sr. | H02G 3/30 174/135 |
| 2003/0066190 A1 | | 4/2003 | Revel et al. | |

FOREIGN PATENT DOCUMENTS

| | | |
|---|---|---|
| EP | 1304773 A1 | 4/2003 |
| EP | 1933428 A2 | 6/2008 |

* cited by examiner

*Primary Examiner* — Tulsidas C Patel
*Assistant Examiner* — Travis Chambers
(74) *Attorney, Agent, or Firm* — William J. Clemens; Shumaker, Loop & Kendrick, LLP

(57) ABSTRACT

An equipping arrangement for equipping a plug housing with fitted-out cable ends of cables with an equipping unit, by which the cable ends are introduced into cells of the plug housing, includes a housing receiving device for temporary reception of the plug housings for the equipping. A cable store holding several of the cables together is temporarily received by the housing receiving device together with the temporary reception of the plug housing in the housing receiving device. A holding arm, on which the cable store is arranged, is connected at right angles with the housing receiving device. A plug-in opening into which a foot section of the cable store can be plugged is provided in the holding arm.

14 Claims, 3 Drawing Sheets

ARRANGEMENT AND METHOD FOR EQUIPPING PLUG HOUSINGS

FIELD

The invention relates to an arrangement for equipping plug housings with fitted-out cable ends of cables. In addition, the invention relates to a method of equipping plug housings. An arrangement of that kind comprises a housing receiving device in which one or more plug housings for the equipping is or are temporarily receivable. The equipping is carried out by means of an equipping unit, by which the cable ends are introducible into cells of the plug housing to be equipped. Such equipping arrangements are frequently downstream of fitting-out installations. A fitting-out installation can in that case comprise a de-insulating station for cutting to length and stripping the electrical cable, one or more crimping stations for application of crimp contacts to the stripped cable ends and optionally bushing stations. The equipping arrangement could, however, also be a component of a fitting-out installation.

BACKGROUND

An arrangement for equipping plug housings with fitted-out cable ends of a cable has been made known from, for example, EP 1 304 773 A1. For the equipping, plug housings are, for the equipping, temporarily received in a housing receiving device consisting of support plate and housing holder. The arrangement comprises an equipping unit with a cable gripper by which the cable ends are introducible into cells of plug housings. Depending on the respective cable layout, cable ends of the cable loops might not be immediately introduced into the provided cells of the plug housing; the cable sections connected with these cable ends are then intermediately stored in a rotatable cable store. This intermediate storage is carried out until the respective intermediately stored cable end can be used for the equipping in correspondence with the equipping sequence according to the cable layout. Due to its high level of complexity, the arrangement and the procedure are complicated and impose high demands in terms of control technology. Only cable loops with fitted-out cable ends can be processed in this equipping arrangement. The arrangement is thus not suitable for cables which are to be equipped with plug housings at just one end.

SUMMARY

It is accordingly an object of the present invention to avoid the disadvantages of the prior art and, in particular, to create an arrangement for equipping plug housings with fitted-out cable ends of cables, which is simple in handling and permits a wide range of use. In particular, it should be possible by an arrangement to equip cables with plug housings at only one end.

According to the invention these objects are fulfilled by an arrangement for equipping plug housings with fitted-out cable ends of cables by an equipping unit, by which the cable ends are introducible into cells of the plug housing, comprising a housing receiving device for temporary reception of plug housings for the equipping process. Temporary in the present case signifies that the plug housings remain at the housing receiving devices only for the comparatively short time period of the equipping process. Thereafter, i.e. after termination of the equipping process, the plug housings are removed from the housing receiving device and delivered for further use.

A number of advantages results from the fact that by the temporary reception of the plug housing in the housing receiving device at least the cable store holding together the cables is also temporarily receivable by the housing receiving device. Thanks to the capability of temporary reception of the cable store in the housing receiving device, new and further possibilities of use result. By "cable store" there is understood here means for securing and arranging the cables. The arrangement is also particularly suitable for cables or cable lengths which are to be equipped at only one end or in which only one cable end is to be equipped with a plug housing.

A holding arm on which the cable store is arranged can be connected with the housing receiving device. The cable store can preferably be arranged in the region of the free end of the holding arm. The holding arm can be fastened to a support plate of the housing receiving device by means of, for example, a screw connection or by other fastening means.

If the housing receiving device comprises a support plate, it can be particularly advantageous if the holding arm is oriented at right angles to the face of the support plate. Housing receiving devices with support plates are known and familiar to the expert also under the designation 'housing palette' or, in abbreviation, 'palette'.

In a preferred form of embodiment the cable store is detachably connectible with the housing receiving device or detachably connected with the housing receiving device during the equipping process. It can thus be ensured that after termination of the equipping process the cable store can be removed in simple manner from the housing receiving device together with the plug housing equipped to finished state and the associated cables.

The equipping device can be operated particularly simply if the cable store can be mounted on the housing receiving device and/or removed from the housing receiving device merely by movement of the cable store relative to the housing receiving device. The mounting and removal can in that case be carried out without tools. Thanks to a design of that kind the mounting and removal with respect to the cable store can be undertaken mechanically and automatically.

The housing receiving device can comprise a plug-in opening into which a foot section of the cable store can be plugged for the setting up. The foot section can be designed to be complementary to the plug-in opening, whereby an advantageous mechanically positive connection between housing receiving device and cable store can be created. Other forms of connection instead of the described plug connection are also conceivable. For example, the cable store can be mechanically connected with the housing receiving device, for example with the help of permanent magnets or activatable electromagnets.

The arrangement can additionally comprise securing means for secure fixing of the cable store plugged into the plug-in opening of the housing receiving device. Such securing means prevent unintended removal of the plugged-in cable store from the housing receiving device. Thus, an 'overhead' mode of operation is also possible by the arrangement. For example, the cable store can be temporarily arranged in the arrangement in such a way that the cable store is disposed below the holding arm and the cables are deposited from below into the cable store in an upward vertical movement upwardly.

By way of example, the securing means can comprise a resiliently mounted detent lug and a corresponding recess in which the detent lug engages when the cable store is plugged in. The detent lug can be arranged in the plug-in opening and the recess in the plug-in opening; a converse association with respect to detent lug and recess would obviously also be conceivable.

A single-row plug housing can, for the equipping, be arranged in the housing receiving device in such a manner that the cells of the plug housing are disposed in a preferably vertical or horizontal row. It can be advantageous for the equipping of single-row plug housings if the cable store and a housing holder for fixing of the plug housing lie substantially on a common, preferably vertical or horizontal, plane. The cable store and the mentioned housing holder can be so positioned and oriented relative to one another during the equipping process that a cable gripper of the equipping unit has to be moved only two-dimensionally not only for depositing the cable in the cable store, but also for subsequent introduction of the cable end into the respective cell of the plug housing. The arrangement can be operated particularly efficiently in this mode and manner.

When the cable store holds the cables together, the cable store can be reciprocatingly guided along the cable longitudinal direction and, in particular, with respect to the opposite, still unequipped, cable ends.

In an advantageous arrangement the cable store has a slot-shaped cable receiving region. In that case the cable receiving region can be so dimensioned that several cables can be received or arranged lying one above another in a row in this cable receiving region. The cables can be particularly satisfactorily arranged and secured in this mode and manner. The sequence of the cables deposited in the cable store is maintained thanks to the cable receiving region thus designed, whereby the cable ends opposite with respect to the plug housing can be further used without complicated rearrangement. The slot-shaped cable receiving region can have a slot width which corresponds with at least the diameter of the cable. The cable store can comprise, for example, two mutually spaced-apart side elements, wherein the cable receiving region is arranged between the two side elements. The side elements are preferably arranged to extend parallel to one another in the cable store. The spacing between the side elements thus corresponds with the stated slot width. The maximum width of the slot of the cable receiving region shall in that case preferably be smaller than twice the cable diameter. Advantageously, a slot width is selected which is 1.2 to 1.5 times the cable diameter. The cable store can be designed in such a way that the slot width is settable for adaptation to different cables.

Additionally or alternatively the cable receiving region of the cable store can have, at the entry side, a blocking element preventing cables, which are already deposited in the cable store, from being able to leave the cable receiving region.

A latch can, for example, be provided for blocking or closing the cable receiving region, which latch in a rest setting closes the cable receiving region. For the deposit process, the latch can be urged away from the cable for freeing the cable receiving region. In other words, the cable receiving region can in passive manner automatically unblock when the cables are deposited.

The latch can, for example, be arranged at a lever part. In that case the lever part can be mounted on a side element of the cable store to be pivotable about an axis. For unblocking or closing the cable receiving region in the rest setting of the lever part, the lever part can be supported against the afore-mentioned side element by means of a spring element for generating a biasing force.

A further aspect of the invention relates to a method of equipping plug housings with fitted-out cable ends of cables, wherein, in particular, the afore-described equipping arrangement is used for the method. The method according to the invention comprises the following steps: The cable ends of cables are introduced into cells of a plug housing by means of an equipping unit, wherein the plug housing is received in a housing receiving device. The cables are deposited beforehand in a cable store, wherein the cable store is received by a cable receiving device. The deposit can preferably take place directly before the mentioned working step of introducing the cable ends into the plug housing. The deposit of the cables in the cable store thus takes place during the feed process in which the cable ends are led to the respective cells of the plug housing.

The cables can be deposited in a cable receiving region of the cable store in such a manner that the deposited cables are arranged in the cable receiving region lying one above the other in a row.

For subsequent further processing of the cables it can be advantageous if after termination of the equipping process the cable store filled with the cables is removed from the housing receiving device together with the plug housing equipped to finished state. The removal can in that case be carried out manually. However, it can be advantageous if the cables with cable store and plug housing are removed from the housing receiving device and brought to a desired location by means of a transfer device.

DESCRIPTION OF THE DRAWINGS

Further individual features and advantages of the invention are evident from the following description of an embodiment and from the drawings in which.

DETAILED DESCRIPTION

Figure 1:
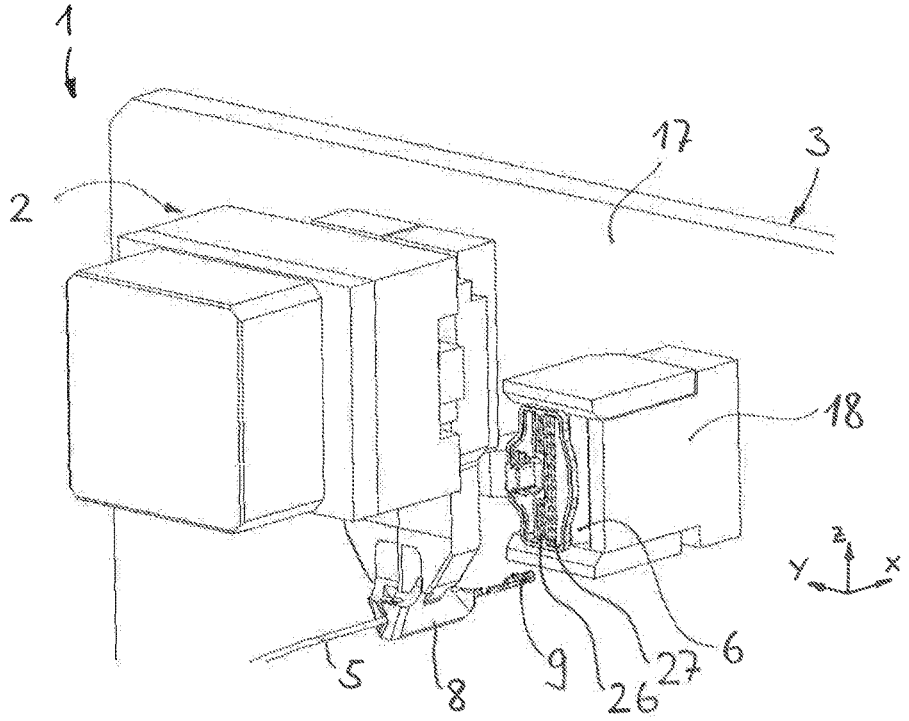
FIG. 1 shows a perspective illustration of an arrangement for equipping a plug housing with fitted-out cable ends of cables by an equipping unit.

FIG. 1 shows an arrangement, which is denoted overall by 1, for equipping plug housings with fitted-out cable ends of cables. This equipping arrangement comprises an equipping unit 2 by which cable ends 9 are introducible into cells 26, 27 of the plug housing 6. The plug housing 6 is, by way of example, of double-row design in FIG. 1. The cells, which are denoted by 26, are arranged in a first vertical cell row and the cells 27 in a second vertical cell row. Instead of double-row plug housings according to the present embodiment other plug housings, particularly single-row or multi-row, plug housings can obviously also be equipped by the arrangement 1. The cable 5 has a crimp contact at the cable end 9. The crimp contact was mounted beforehand in a crimping station (not illustrated) on a stripped cable end. A cable gripper 8 of the equipping unit 2 grips the cable 5 closely behind the crimp contact at the cable end 9. The cable gripper 8 could, for introducing the cable end 9 into the cell 26, 27 of the plug housing 6, be moved towards the plug housing. However, it is also conceivable to leave the cable gripper 8 stationary at least for a time, whilst the housing receiving device 3 is moved, or also combined movements of cable gripper 8 and housing receiving device 3 (cf. FIGS. 5*a-c*, 6*a-c*). The arrangement 1 comprises a housing receiving device 3 for temporary reception of plug housings for the equipping process. In the present embodiment, only one plug housing 6 is received in the housing receiving device 3. It is obviously also conceivable to process several plug housings.

The housing receiving device 3 comprises a support plate 17, at the planar, for example vertically extending, upper side 23 (FIG. 2) of which a housing holder 18 for holding the plug housing 6 is arranged. The term 'housing palette' is used in the expert world for such or similar housing receiving devices 3. An equipping arrangement comparable with the arrangement 1 shown in FIG. 1 has also become known from, for example EP 1 304 773 A1. The arrangement 1 according to the invention is distinguished by the fact that it includes a special cable store (not illustrated here) for securing and arranging the cables 5 leading away from the cable ends 9 introduced into the cells 26, 27. This special cable store is shown subsequently in FIGS. 2 to 4 and explained in detail in the following.

Figure 2:
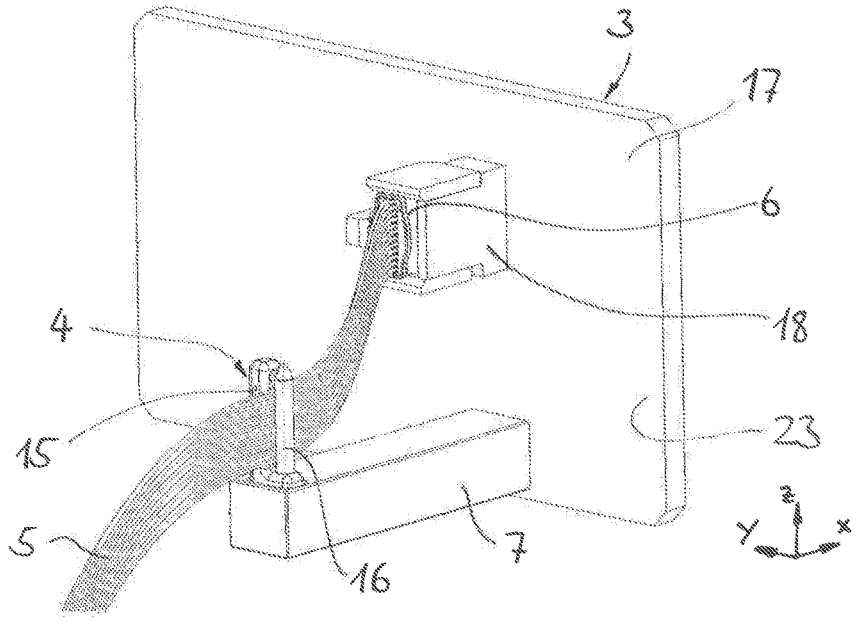
FIG. 2 shows a housing receiving device for the arrangement of FIG. 1 with a plug housing, which is equipped to finished state and a cable store for holding together the cables.

FIG. 2 shows the housing receiving device 3, wherein—for better understanding of the position, orientations and movement sequences—a Cartesian co-ordinate system with x, y and z axes is illustrated. In FIG. 2 the plug housing 6 is already equipped to finished state. The cables 5 introduced into the plug housing 6 are, as apparent, held together by a cable store 4 which orders and secures the cables 5.

Figure 3:
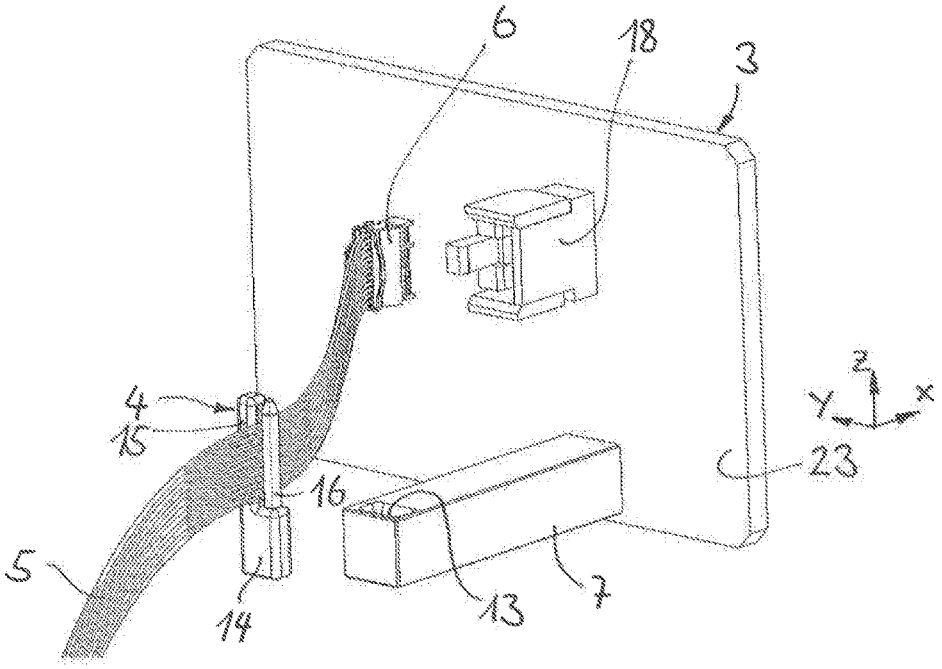
FIG. 3 shows the arrangement of FIG. 2, but with plug housing and cable store removed from the housing receiving device.

The vertical support plate 17 of the housing receiving device 3 has a planar upper side 23, which extends plano-parallelly to the plane y-z. A horizontal holding arm 7 connected at right angles with the face 23 of the support plate 17 is arranged at the support plate 17. The holding arm 7 thus extends, in the present case, in the horizontal direction x. The holding arm 7 is, for example, fastened to the support plate 17 by means of a screw connection. The mentioned cable store 4 for holding together the plurality of cables 5 is temporarily received at the free end of the holding arm 7. The cable store 4 is detachably connected with the housing receiving device 3, so that after termination of the equipping process the cable store 4 together with the plug housing 6 equipped to finished state and the associated cables 5 can be removed from the housing receiving device 2. This setting is shown in FIG. 3. As evident from FIG. 3, the cables 5, the plug housing 6 and the cable store 4 form a unit which is designed to be mobile and which can be brought in simple manner to a desired location for further processing. A plug-in opening 13 into which the cable store 4 can be plugged can be seen in FIG. 3. The part of the cable store 4 serving for the plug connection is termed foot section 14. The cable store 4 can be removed from the housing receiving device 3 and mounted on the housing receiving device 3 by a relative movement of the cable store 4 with respect to the housing receiving device 3. Additional tools for mounting or removing are not necessary. The cable store 4 has two side elements 15 and 16 which project from the holding arm 7 in z direction. The cable is arranged in the form of a cable family, with cables 5 arranged in a row one above the other, between the two side elements 15, 16. Constructional details with respect to the design of the cable store can be inferred from the sectional illustration according to FIG. 4.

Figure 4:
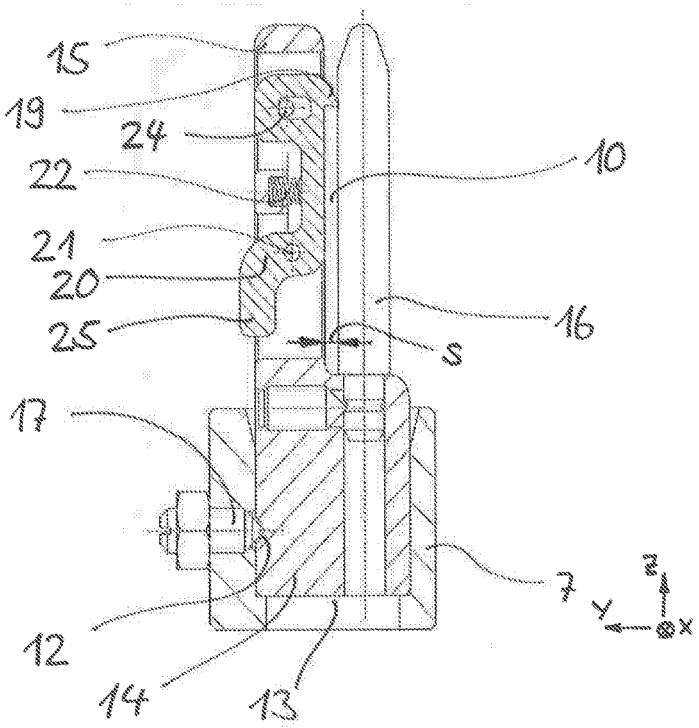
FIG. 4 shows a sectional illustration through the cable store according to the embodiment of FIGS. 2 and 3, FIGS. 5*a* to 5*c* show the equipping arrangement in three different settings, wherein a plug housing is equipped with a fitted-out cable end of a first cable

FIG. 4 shows the cable store 4, which is temporarily connected with the holding arm 7 of the housing receiving device by way of a plug connection. The foot section 14 of the cable store 4 is formed to be complementary to the plug-in opening 13, whereby a mechanically positive connection between cable store 4 and holding arm 7 results. Securing means are provided for secure fixing of the cable store 4, which is plugged into the plug-in opening 13 of the housing receiving device, against unintended removal. Provided for that purpose at the holding arm 7 in the region of the plug-in opening 13 is a spring pressure member with a detent lug 17 which for securing the plugged-in cable store 4 engages in a recess 12 in the foot section 14. Other securing means would also be conceivable instead of the detent lug 17 and recess 12 shown here.

The two side elements 15 and 16 of the cable store 4 are in the present instance formed by a housing part for the first side element 15 and by a pin for the second side element 16. The mentioned housing part is integrally connected with the foot section 14 and forms therewith a monolithic shaped body of a material which is, for example, metallic. The pin 16 is received and fixed in a bore in this housing part.

The cable receiving region, which is denoted by 10, is of slot-shaped form, the slot width being denoted by 's'. As apparent from, for example, FIG. 3, the slot-shaped cable receiving region 10 is so dimensioned that several cables 5 can be arranged in the cable receiving region 10 lying one above the other in a row. Advantageously, a slot width s corresponding with 1.2 to 1.5 times the cable diameter of cable 5 is selected.

The cable receiving region 10 has at the entry side a blocking element formed by a latch 19. This blocking element prevents cables 5, which are already deposited in the cable store 4, from being able to leave the cable receiving region 10. In the rest setting shown in FIG. 4 the latch 19 closes off the cable receiving region 10. The lever part 20 is received in a slot of the housing part in the first side element 15. The lever part 20 is in that case pivotably mounted in this side element 15. The corresponding pivot axis is denoted by 21. In order to produce the rest setting the lever part 20 is supported at the side element 15 by means of a spring element 22, which is formed by a helical compression spring, for generating a biasing force. For the deposit process, the latch 19 can, for freeing the cable receiving region 10, be urged away from the cables moved into the cable receiving region. The latch 19 is a component of a lever part 20 and is arranged at the upper end of the lever part 20. A grip section 25 is provided at the lower end of the lever part 20. The lever part 20 can be pivoted by pressing on the grip section 25 and thus the latch brought into an open setting. This opening movement is limited by a pin 24, which is press-fitted in the side element 15 or fixed therein in another way and which is received within a guide, which is formed by a transversely disposed slot, of the lever part 20 in the region of the latch 19.

Instead of the multi-part cable store 4 described by way of FIG. 4, integral variants are also conceivable. With respect to large-scale manufacture it could be possible, with appropriate adaptations, to also construct the cable store 4 as a plastics-material injection-molded part.

Figure 5A:
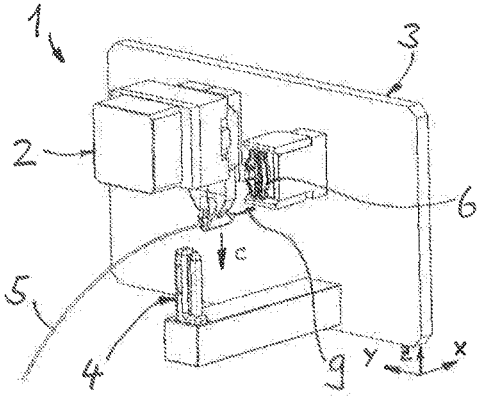
Figure 5B:
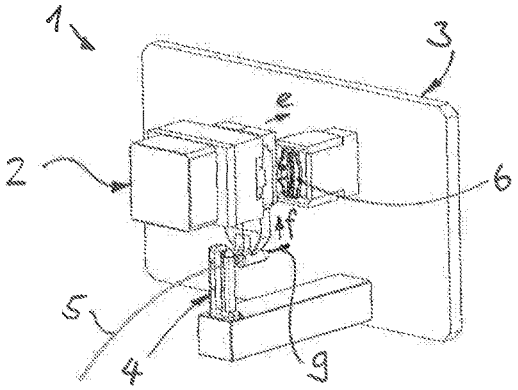
Figure 5C:
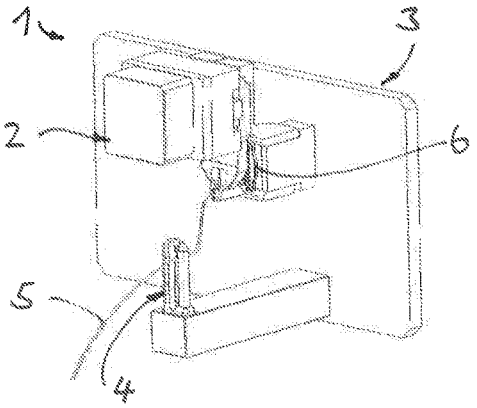

Individual method sequences of the method for equipping the plug housing 6 with cables 5 with use of the arrangement 1 described in the foregoing are shown in FIGS. 5*a* to 5*c*. In FIG. 5*a*, the equipping unit 2 with the cable gripper is already disposed in the vicinity of the plug housing 6. Before the cable end 9 of the cable 5 is introduced into the appropriate cell of the plug housing 6 the first cable 5 is, however, deposited in the cable store 4. The deposit direction is indicated by the arrow c. The movement can be carried out either by the equipping unit 2 or by the housing receiving device 3. In FIG. 5*b* the equipping unit is disposed in a setting in which, for deposit of the cable 5, the cable is led through the receiving region of the cable store 4. The equipping process can thereafter be finished off. For that purpose, the gripper of the equipping unit 2 has to be moved upwardly in f direction and as soon as the cable end 9 is axially aligned with the appropriate cell of the cable housing 6 the gripper can move the cable end 9 in insertion direction e. In FIG. 5*c* the equipping unit 2 is in an end setting in which the cable end 9 is introduced into the plug housing 6. The movements indicated by the arrows c, f and e can be executed by the equipping unit 2 or by the housing receiving device 3. Combinations are also conceivable. Moreover, it can be advantageous in certain circumstances if merely axial movements in the direction of the x axis are performed by the equipping unit 2. The deposit process indicated by the arrow c as well as the vertical positioning, which is indicated by the arrow f, of the cable 9 would in this case be performed by the housing receiving unit 3. Thus, merely the actual introduction process would be carried out by the equipping unit 2. The equipping process would be concluded by the horizontal movement of the equipping unit 2 in e direction.

Figure 6A:
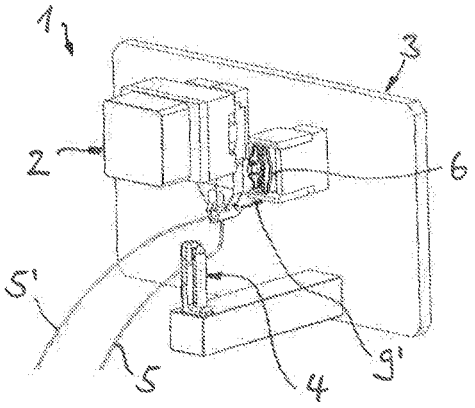
FIGS. 6*a* to 6*c* show the equipping arrangement in three different settings in the equipping of the plug housing with a fitted-out cable end of a second cable.
Figure 6B:
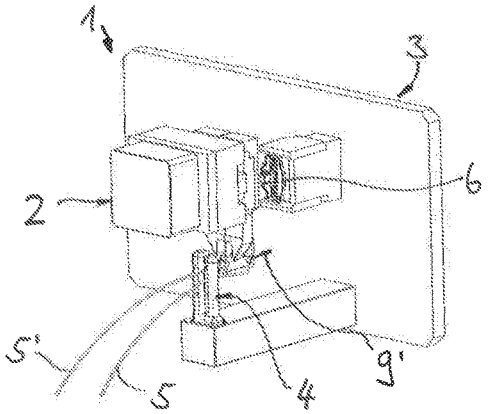
Figure 6C:
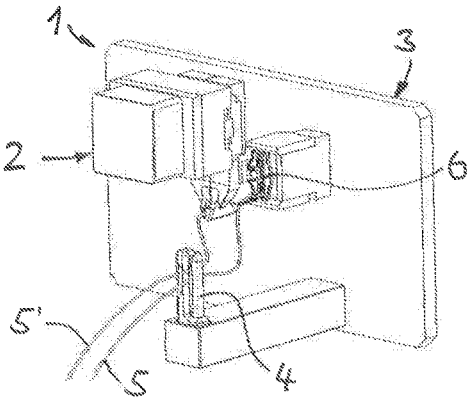

After the first cable end of the first cable 5 has been inserted into the plug housing 6 the gripper of the equipping unit 2 releases the cable and a second cable can be brought up. The analogous method sequences for the second cable, which is denoted by 5', are illustrated in FIGS. 6*a* to 6*c*.

In the present embodiment a double-row plug housing 6 is equipped, for which reason the cable gripper 8 and/or the housing receiving device 3 must be movable in three directions (x, y, z). For a mere single-row plug housing the following mode of operation would be conceivable: The cable store 4 and the housing holder 18 for fixing the plug housing 6 lie on a common vertical plane extending plano-parallelly to x-z. The cable store 4 and housing holder 18 can, for the equipping process, be positioned and oriented in such a way that the cable gripper has to be moved only two dimensionally not only for depositing the cable 5, 5' in the cable store 4, but also for introducing the cable end 9, 9' into the respective cell of the single-row plug housing.

In the present embodiment cables are equipped at one end with plug housing 6. The cable store 4 has particular advantages if further operations, in which the sequence is to be maintained, have to be carried out with the unequipped cable ends. For example, in the case of the mentioned operations on the unequipped cable ends, housing equipping actions are carried out which are performed on a board by hand. However, in principle, it would also be conceivable to additionally use the equipping arrangement 1 for cables in the form of cable loops which are to be equipped at both ends. In this case, for example, a housing receiving device having two housing holders, which are preferably arranged adjacent to one another, for two plug housings would be used for the arrangement 1. A second, identically designed cable store would then be temporarily received in the same holding arm 7 or possibly a second holding arm. The cable would then be deposited in the first cable store 4 in the region of one cable end and the cable deposited in the region of the opposite cable end in the second cable store (not illustrated), as a result of which they can be stored securely and in ordered manner.

Two and more plug housings are frequently received at the housing receiving device 3 at the same time. In this case it can be advantageous if the cables 5 leading away from at least two and possibly all plug housings, which are equipped to finished state and which are temporarily present on the housing receiving device 3, are held together by a common cable store 4.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An arrangement for equipping a plug housing with fitted-out cable ends of cables by an equipping unit, by which the cable ends are introduced into cells of the plug housing, comprising:

a housing receiving device temporarily receiving the plug housing for the equipping with the fitted-out ends of the cables; and a cable store holding together the cables and temporarily received by the housing receiving device, wherein the cable store is detachably connected with the housing receiving device, and the cable store together with the plug housing are removable from the housing receiving device.

2. The arrangement according to claim 1 wherein the cable store is adapted to be at least one of mounted on the housing receiving device and removable from the housing receiving device by a relative movement of the cable store with respect to the housing receiving device.

3. The arrangement according to claim 1 wherein the cable store is connected with the housing receiving device by a plug connection.

4. The arrangement according to claim 1 wherein the cable store and a housing holder on the housing receiving device for fixing the plug housing lie on a common plane when the cable store is received by the housing receiving device.

5. The arrangement according to claim 1 wherein the cable store has a slot-shaped cable receiving region, wherein the cable receiving region is dimensioned for receiving or arranging several of the cables lying one above the other in a row.

6. The arrangement according to claim 1 wherein the cable store has a cable receiving region, wherein at an entry side of the cable receiving region a blocking element prevents the cables already deposited in the cable store from being able to leave the cable receiving region.

7. The arrangement according to claim 1 including a holding arm connected with the housing receiving device, wherein the cable store is arranged on the holding arm.

8. The arrangement according to claim 7 wherein the housing receiving device includes a support plate and the holding arm is oriented at right angles to a face of the support plate.

9. The arrangement according to claim 1 wherein the housing receiving device has a plug-in opening into which a foot section of the cable store is plugged.

10. The arrangement according to claim 9 including securing means for securely fixing the cable store plugged into the plug-in opening of the housing receiving device.

11. The arrangement according to claim 10 wherein the securing means includes a resiliently mounted detent lug and a corresponding recess formed in the cable store, wherein the detent lug engages in the recess when the cable store is plugged into the plug-in opening.

12. A method of equipping a plug housing with fitted-out cable ends of cables comprising the following steps:

depositing the cables in a cable store temporarily received by a housing receiving device;

introducing the fitted-out cable ends of the cables into cells of the plug housing with an equipping unit, wherein the plug housing is received in the housing receiving device; and removing the cable store filled with the cables together with the plug housing from the housing receiving device.

13. The method according to claim 12 wherein the cables are deposited in a cable receiving region of the cable store the deposited cables are arranged in the cable receiving region lying one above the other in a row.

14. An arrangement for equipping a plug housing with fitted-out cable ends of cables by an equipping unit, by which the cable ends are introduced into cells of the plug housing, comprising:

a housing receiving device temporarily receiving the plug housing for the equipping with the fitted-out ends of the cables; and a cable store holding together the cables and temporarily received by the housing receiving device, wherein the cable store has a cable receiving region, wherein at an entry side of the cable receiving region a blocking element prevents the cables already deposited in the cable store from being able to leave the cable receiving region.

* * * * *